US005174086A

United States Patent [19]

Payne et al.

[11] Patent Number: 5,174,086

[45] Date of Patent: Dec. 29, 1992

[54] METHOD FOR MAKING A FABRIC FILE CONSTRUCTION

[75] Inventors: Michael W. Payne, Roswell, Ga.; Cathy A. Ptacek, Hamilton; Daniel J. Mack, Holland, both of Mich.

[73] Assignee: Herman Miller, Inc., Zeeland, Mich.

[21] Appl. No.: 885,113

[22] Filed: May 18, 1992

Related U.S. Application Data

[62] Division of Ser. No. 484,176, Feb. 23, 1990, Pat. No. 5,129,202.

[51] Int. Cl.[5] ..... E04B 2/00

[52] U.S. Cl. ..... 52/747; 52/144; 52/145; 52/36; 52/239; 40/157

[58] Field of Search ..... 52/747, 144, 145, 36, 52/239, 511, 222, 273; 40/157, 320, 603, 605; 160/327, 328, 354, 368.1, 402, 403

[56] References Cited

U.S. PATENT DOCUMENTS

| | | | |
|---|---|---|---|
| 836,010 | 11/1906 | Brown . | |
| 1,399,023 | 12/1921 | Murray . | |
| 1,896,875 | 2/1933 | Walters . | |
| 1,903,469 | 4/1933 | Meader | 52/511 |
| 1,960,949 | 5/1934 | Miller et al. | 52/511 |
| 2,262,426 | 11/1941 | Hall . | |
| 2,308,869 | 1/1943 | Eckardt . | |
| 2,401,906 | 6/1946 | Burnett et al. . | |
| 2,466,190 | 4/1949 | Westman et al. | 52/511 |
| 2,486,563 | 11/1949 | Jorgensen . | |
| 2,582,144 | 1/1952 | Miles . | |
| 2,951,299 | 9/1960 | Fisco . | |
| 3,205,628 | 9/1965 | Frisk | 52/511 |
| 3,328,927 | 7/1967 | Kates . | |
| 3,460,299 | 8/1969 | Wilson . | |
| 3,861,493 | 1/1975 | Payne . | |
| 4,083,157 | 4/1978 | Anthonioz | 52/222 |
| 4,250,676 | 2/1981 | Presby . | |
| 4,279,087 | 7/1981 | Crawford | 40/603 |
| 4,640,076 | 2/1987 | Migliore . | |
| 4,685,255 | 8/1987 | Kelley . | |
| 4,711,058 | 12/1987 | Patton . | |
| 4,744,189 | 5/1988 | Wilson . | |
| 4,832,152 | 5/1989 | Schuelke et al. . | |

FOREIGN PATENT DOCUMENTS

| | | |
|---|---|---|
| 373527 | 6/1990 | European Pat. Off. . |
| 2458835 | 6/1976 | Fed. Rep. of Germany . |
| 3445231 | 6/1986 | Fed. Rep. of Germany . |
| 1408002 | 6/1965 | France . |
| 2120429 | 8/1972 | France . |

*Primary Examiner*—David A. Scherbel
*Assistant Examiner*—Wynn E. Wood
*Attorney, Agent, or Firm*—Varnum, Riddering, Schmidt & Howlett

[57] ABSTRACT

A fabric tile which is formed of a metal pan having tightly stretched thereover a fabric sock. The fabric sock is attached to the metal pan by way of mounting or attachment clips which are sewed and glued to edge portions of the fabric sock and which are engaged over terminal return flanges of the metal pan. Each clip is elongated and extends a major portion of an edged dimension of the metal pan and is of a J-shaped cross section. Each clip includes an elongated stem which terminates in a generally U-shaped hook. The hook includes a first leg which is a continuation of the stem and a second leg disposed in spaced parallel relation to the first leg by way of an integral base. The second leg has a terminal free edge portion which is flared relative to the first leg so as to facilitate engagement of the clip with the metal pan.

5 Claims, 2 Drawing Sheets

METHOD FOR MAKING A FABRIC FILE CONSTRUCTION

This is a division of application Ser. No. 484,176 filed Feb. 23, 1990, now U.S. Pat. No. 5,129,202.

This invention relates in general to new and useful improvements in wall tiles, and more particularly to a fabric wall tile in which a metal pan has a fabric sock stretched thereover and held in place by plastic clips.

BACKGROUND ART

Open-plan office systems pioneered by Herman Miller, Inc. provide a series of rigid frames which, in turn, are rigidly connected together at facing edges to divide work spaces into work or task areas. Modular tiles are removably mounted to the faces of both sides of the frame. Such open-plan office systems are disclosed in U.S. Pat. No. 4,685,255 to Kelley, granted Aug. 11, 1987 and U.S. Pat. No. 4,832,152 to Schuelke et al., granted May 23, 1989.

In accordance with the above-identified patents, metal panels or pans are provided and these may be provided with a fabric or a vinyl covering. Heretofore, fabric has typically been glued to the metal pans. The underside of the fabric has been covered with adhesive. The metal pans have then been placed upside down on the fabric. Because of the difference in the nature of the fabrics different glues have been required with different fabrics. However, certain fabrics have been found unsuitable for any known glue. Further, even when the fabrics are successfully glued to pans, some field conditions can result in ungluing of portions of the fabrics from the pans. Further, the process is labor-intensive and requires a certain amount of skill to perform the operation correctly.

As is best shown in FIG. 4 of U.S. Pat. No. 4,685,255, the metal pans are mounted on a supporting frame including vertical members. Each metal pan is provided with lower hook-shaped clips and upper rearwardly projecting spring clips which are received in suitable slots formed in the frame members.

Anthonioz, U.S. Pat. No. 4,083,157 granted Apr. 11, 1978, discloses the use of metal clips for fixing edges of a false ceiling or wall to a retaining support.

SUMMARY OF THE INVENTION

According to the invention, there is provides a method for manufacturing a wall tile comprising a fabric-covered metal pan, the metal pan having a front face, rearwardly extending side edges and a marginal return flange carried by each of the side edges. A rectangular fabric is sized to cover at least the front face and side edges of the metal pan and has four substantially linear side edges. Hook-bearing clips are attached to the side edges of the fabric. The fabric is then applied to the face and side edges of the metal pan and the hooks of the clips are fitted onto the marginal return flanges of the metal pan to secure the fabric to the metal pan.

The clips are preferably J-shaped and include an elongated stem terminating in a U-shaped hook portion with the elongated stem being secured to the fabric. Further, the clips preferably extend along a major portion of the side edges of the fabric. In a preferred embodiment, the clips are first adhesively secured to the fabric to position the clips on the fabric and are then sewn to the fabric to secure the clips to the fabric.

The clips are preferably made from a soft plastic material such as polyvinyl chloride and can be extruded.

BRIEF DESCRIPTION OF THE DRAWINGS

The invention will now be described with reference to the accompanying drawings in which.

BEST MODE FOR CARRYING OUT THE INVENTION

Figure 1:
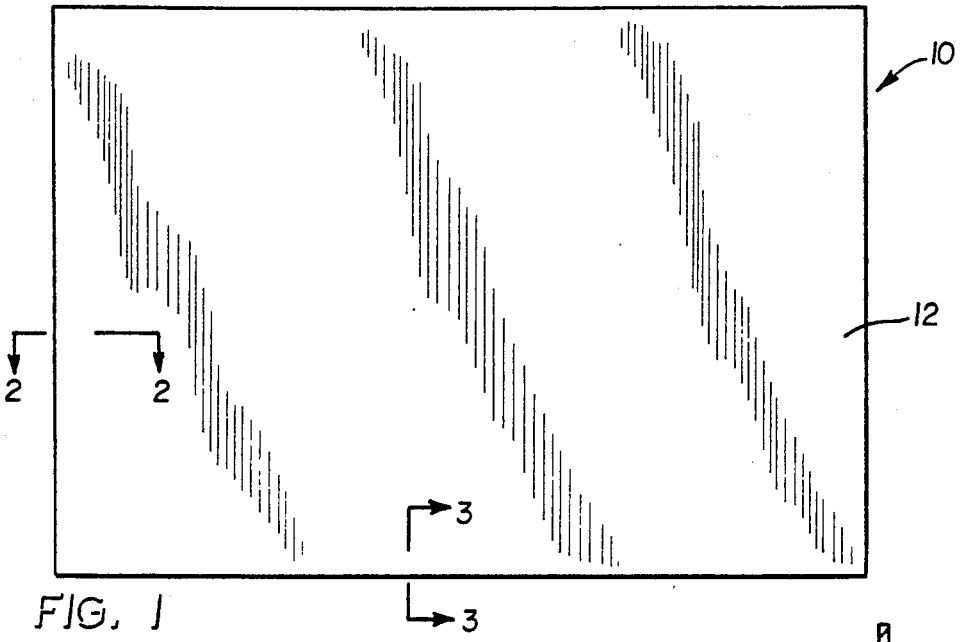
FIG. 1 is a front elevational view of a rectangular metal pan to which a fabric sock is to be secured in accordance with this invention.
Figure 2:
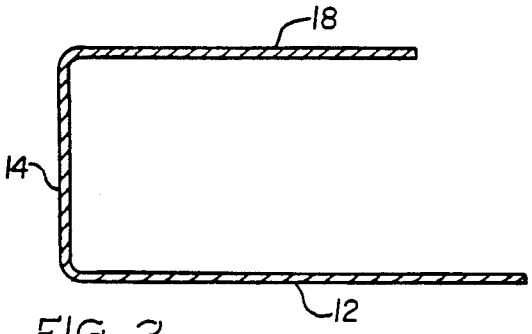
FIG. 2 is an enlarged fragmentary horizontal sectional view taken generally along the line 2—2 of FIG. 1 and shows the typical cross section of a horizontal edge of the metal pan.
Figure 3:
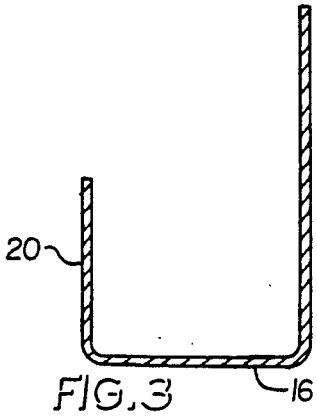
FIG. 3 is an enlarged fragmentary vertical sectional view taken generally along the line 3—3 of FIG. 1 and shows a typical vertical cross section of an upper or lower edge of the metal pan.

Referring now to the drawings in general and FIGS. 1-3 in particular, it will be seen that there is illustrated a metal pan which is generally rectangular in outline and which is generally identified by the reference numeral 10. The metal pan 10 will be of a general configuration such as the metal pan shown in FIG. 4 of U.S. Pat. No. 4,685,255 and will be mounted with respect to a supporting framework in the same manner as will be described in more detail hereinafter.

The metal pan 10 includes a front face 12 which is preferably planar. The front face 12 has folded rearwardly thereof at opposite vertical edges sides 14. At the top and bottom of the front panel 12 there are rearwardly extending ends 16. The sides 14 are provided with inwardly directed terminal return flanges 18 while the ends 16 are provided with rearwardly directed terminal return flanges 20. The return flanges 18 and 20, in accordance with this invention, will be utilized for engagement by mounting clips to secure a fabric sock on the metal pan 10 in tensioned relation across both the front face 12 and the sides 14 and ends 16 of the metal panel 10.

Figure 4:
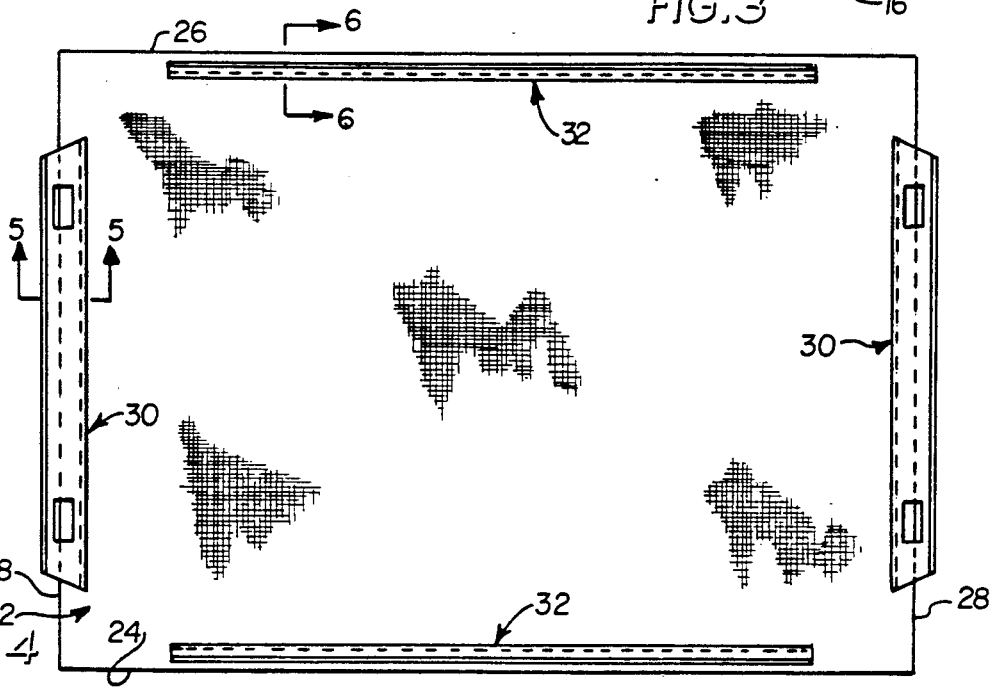
FIG. 4 is a rear elevational view of the fabric sock which is to be applied to the metal pan of FIG. 1 and shows the arrangement of mounting clips thereon.

Reference is now made to FIG. 4 wherein there is illustrated a fabric sock formed in accordance with this invention and generally identified by the reference numeral 22. The fabric sock 22 is illustrated as being generally rectangular and having what becomes an upper edge 24, a lower edge 26 and side edges 28. Identical mounting clips, generally identified by the numeral 30, preferably of a resilient plastic material, are suitably attached to the fabric sock 24, such as by sewing and bonding, with the mounting clip 30 extending beyond the associated edge 28. It is to be noted that the mounting clips 30 are elongated and extend for a major portion of the length of the respective side edge 28.

Identical mounting clips 32 preferably of a resilient plastic are carried by upper and lower edge portions of the fabric sock 24 and are spaced inwardly of the edges 24, 26 of the fabric sock 22. It is to be noted that the mounting clips 32 are also elongated and extend for a major portion of the edges 24, 26 of the fabric sock 22. In the illustrated embodiment of the invention, the metal pan 10 will be wider than it is high with the result that the mounting clips 32 will be longer than the mounting clips 30.

Figure 5:
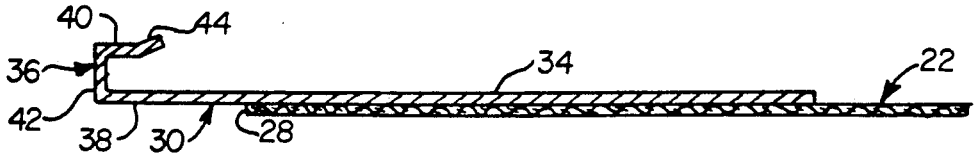
FIG. 5 is an enlarged fragmentary vertical sectional view taken generally along the line 5—5 of FIG. 4 and shows the specific detail of a first mounting clip and its relationship to an edge of the fabric.

Referring now to FIG. 5, it will be seen that a typical mounting or attachment clip 30 is J-shaped in cross section and includes an elongated stem 34 which terminates in a U-shaped hook 36. The hook 36 includes a first leg 38 which forms a continuation of the stem 34, and a second leg 40 disposed in generally spaced parallel relation with respect to the first leg 38 and secured thereto by an integral base 42. A free edge portion 44 of the second leg 40 flares outwardly away from the first leg 38 so as to facilitate attachment of the clip to a terminal return flange 18 of the metal pan 10.

Figure 6:
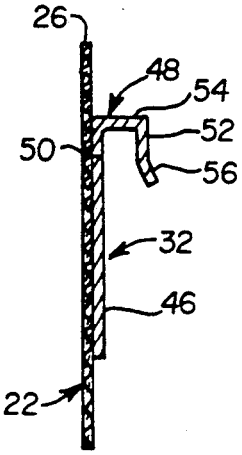
FIG. 6 is an enlarged fragmentary vertical sectional view taken generally along the line 6—6 of FIG. 4 and shows the specific details of a second mounting clip which is to be connected to the upper and lower edges of the metal pan.

As is clearly shown in FIG. 6, each of the mounting or attachment clips 32 is also of a J-shaped cross section and includes an elongated stem 46 which corresponds to, but is clearly shorter than the stem 34. The stem 46 terminates in a generally U-shaped hook 48.

The hook 48 includes a first leg 50 which forms a continuation of the stem 46 and a second leg 52 which is maintained in spaced parallel relation to the first leg 50 by an integral base 54. The second leg 52 has a free edge portion 56 which flares away from the first leg 50 so as to facilitate engagement of the clips 32 with the terminal return flanges 20 of the metal pan 10.

It will be seen that the fabric 22 is so attached to the stem 46 so that the clip 32 lies inwardly of an adjacent free edge 26 of the fabric 22. Like the stem 34, the stem 46 is secured to the fabric 22 by sewing and bonding. The clips are preferably accurately placed on the back of the fabric with a suitable pressure-sensitive adhesive, glue or double-faced adhesive tape and are thereafter sewed in place.

At this time it is to be noted that the exterior of the corner between each base and its respective leg of the two hooks 36, 48 are 90° corners and thus aid to the stiffness of the hooks 36, 48 and the resistance thereof against opening.

Figure 7:
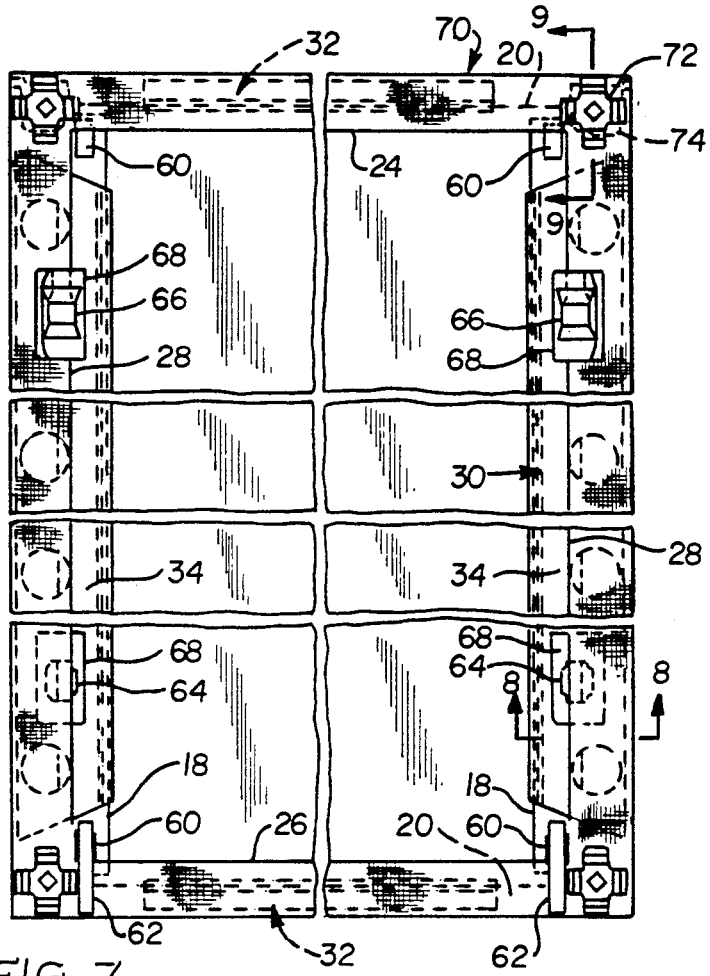
FIG. 7 is a rear elevational view of the metal pan of FIG. 1 with vertical and horizontal portions thereof broken away and with the fabric sock being mounted on the metal pan, and the metal pan being provided with clips for mounting the same on a supporting framework.

Referring now to FIG. 7, it will be seen that the fabric sock 22 is so proportioned whereby when it is inverted from the position of FIG. 4 so as to lie across the face 12 of the metal pan 10, and the clips 30 are engaged over the terminal return flanges 18 as shown in FIG. 7, the fabric sock 22 is pulled tightly across the front of the front face 12 and around the side edges 14 of the metal pan 10. Thereafter, the clips 32 are engaged around the free edges of the terminal return flanges 20 so as to tension the fabric sock 22 in a horizontal direction.

Figure 8:
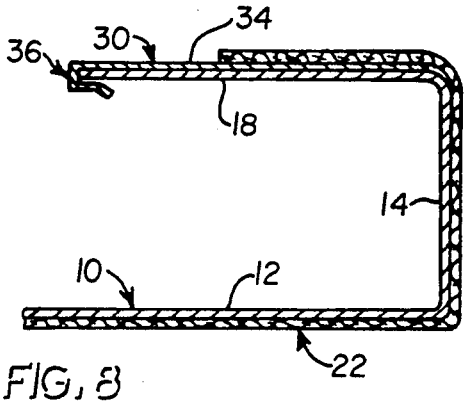
FIG. 8 is a horizontal sectional view taken generally along the line 8—8 of FIG. 7 and shows the specific securement of a vertical edge of the fabric sock to the metal pan utilizing the mounting clip of FIG. 5.

Referring now to FIG. 8, it will be seen that the fabric sock 22 substantially encloses the entire metal pan 10 with the fabric of the fabric sock 22 being tightly drawn across the front face 12 and around the side edges 14. The fabric of the fabric sock 22 will also be drawn in a like manner around the top and bottom edges 16 of the metal pan.

Returning now to FIGS. 4 and 7, it will be seen that in FIG. 7 the terminal return flanges 18 are provided adjacent to their opposite ends with openings 60 into which may be engaged clips 62 for attaching the metal panel 10 to a supporting framework. The clips 62 will correspond to the clips 68 shown in FIG. 4 of U.S. Pat. No. 4,685,255. Further, the terminal return flanges 18 will be provided with openings or notches 64 which, remote from the clips 62 will be provided with retaining spring clips 66 which correspond to the spring clips 69 of FIG. 4 of U.S. Pat. No. 4,685,255.

In order that the clips 30 may clear the notches or openings 64 and the associated clips 66, the stem 34 of each of the clips 30 is provided with openings 68 which will clear the spring clips 66.

Figure 9:
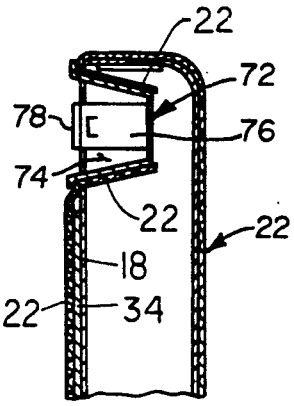
FIG. 9 is a fragmentary vertical sectional view taken generally along the line 9—9 of FIG. 7 and shows the specific details of a retainer clip for holding a corner of the fabric sock against the rear of the metal pan.

Finally, it is to be noted that at each of the rear corners of the fabric tile 70 which is formed of the metal pan 10 and the fabric sock 22, there are retainer clips 72 which, as is best shown in FIG. 9, are snapped through openings 74 in the terminal return flanges and include fingers 76 with offset ends 78 which bear against the fabric 22 to hold it in place at its corners. Thus the fabric 22 is tightly held relative to the metal pan 10.

It is also pointed out at this time that since the edges 24, 26 of the fabric 22 extend beyond their respective clips 32, these edge portions of the fabric sock 22 may be folded over and held in place.

Although the hooks 36 and 48 have been illustrated and described as being continuous, the hooks may be in the form of narrow spaced elements.

Reasonable variation and modification are possible within the scope of the foregoing disclosure and drawings without departing from the spirit of the invention which is defined in the appended claims.

The embodiments of the invention in which an exclusive property or privilege is claimed are defined as follows:

1. A method for manufacturing a wall tile comprising a fabric covered pan, the pan having a front face, rearwardly extending side edges and a marginal return flange carried by each of the side edges, the process comprising the steps of:

providing a rectangular fabric which is sized to cover at least the front face and side edges of the pan and which has four substantially linear side edges;

attaching hook-bearing clips to the side edges of the fabric; and applying the fabric to the face and side edges of the pan and fitting the hooks of the clips onto the marginal return flanges of the pan to secure the fabric to the pan.

2. A method for making a wall tile according to claim 1 wherein the clips are J-shaped and include an elongated stem terminating in a U-shaped hook portion with the elongated stem being secured to the fabric.

3. A method for making a wall tile according to claim 2 wherein the clips extend along a major portion of the side edges of the fabric.

4. A method for making a wall tile according to claim 3 wherein the clips are first adhesively secured to the fabric and then sewn to the fabric.

5. A method for making a wall tile according to claim 1 wherein the clips are first adhesively secured to the fabric and are thereafter sewn to the fabric.

* * * * *